US008658927B2

(12) United States Patent
Mohtasham et al.

(10) Patent No.: US 8,658,927 B2
(45) Date of Patent: Feb. 25, 2014

(54) ANTI-TAMPER SAFETY SWITCH SYSTEM WITH GUARD LOCKING

(75) Inventors: Medi Mohtasham, Astley (GB); Hamed Faridfar, Atherton (GB)

(73) Assignee: Idem Safety Switches Limited, Hindley Green, Wigan (GB)

( * ) Notice: Subject to any disclaimer, the term of this patent is extended or adjusted under 35 U.S.C. 154(b) by 167 days.

(21) Appl. No.: 13/436,505

(22) Filed: Mar. 30, 2012

(65) Prior Publication Data

US 2012/0247931 A1 Oct. 4, 2012

(30) Foreign Application Priority Data

Apr. 1, 2011 (GB) ..... 1105577.9

(51) Int. Cl.
*H01H 5/08* (2006.01)

(52) U.S. Cl.
USPC ..... 200/434; 200/43.04; 200/334

(58) Field of Classification Search
USPC ..... 200/434, 43.04, 43.11, 43.07
See application file for complete search history.

(56) References Cited

U.S. PATENT DOCUMENTS

| | | | | |
|---|---|---|---|---|
| 5,516,993 | A | 5/1996 | Wecke et al. | |
| 5,703,339 | A | 12/1997 | Rapp et al. | |
| 5,777,284 | A * | 7/1998 | Mohtasham | 200/43.04 |
| 6,037,551 | A | 3/2000 | Fukui et al. | |
| 6,118,087 | A * | 9/2000 | Fukui | 200/43.04 |
| 6,307,167 | B1 * | 10/2001 | Kajio et al. | 200/43.11 |
| 6,483,053 | B2 * | 11/2002 | Kajio et al. | 200/43.07 |
| 6,872,898 | B2 * | 3/2005 | Mohtasham | 200/43.01 |
| 7,504,597 | B2 * | 3/2009 | Shimazu et al. | 200/43.04 |
| 2008/0017492 | A1 | 1/2008 | Hiltl et al. | |

FOREIGN PATENT DOCUMENTS

| | | |
|---|---|---|
| GB | 1105575.3 | 8/2011 |
| GB | 1105577.9 | 8/2011 |
| WO | WO 93/24947 | 12/1993 |

* cited by examiner

*Primary Examiner* — Kyung Lee
(74) *Attorney, Agent, or Firm* — Quarles & Brady LLP; Gavin J. Milczarek-Desai

(57) ABSTRACT

A solenoid plunger 14 of the switch 4 is moved by cam plunger 34 and is biased towards the cam plunger 34, a locking plate **40*b* is positioned between the plungers 14 and 34. Cam 34 is biased for movement towards a cam 22 and is moved towards the solenoid plunger by rotation of the cam 22 by removal of actuator 8 which causes retraction of the solenoid plunger into the switch 4. The locking plate 40*b* is lockable when the cam plunger 34 is biased into a detent 36 in the cam 22 when the actuator is inserted, to lock the cam plunger 34 and cam 22 and prevent removal of the actuator 8**.

13 Claims, 9 Drawing Sheets

ANTI-TAMPER SAFETY SWITCH SYSTEM WITH GUARD LOCKING

The present invention relates to safety switches and in particular safety interlock switches with an integral cam operating mechanism which cam is actuator operated.

Safety interlock switches are usually mounted adjacent a guard door of a machine and stop the operation of the machine when the guard door is opened in order to prevent injury to personnel by for example moving internal components of the machine. The switch has normally closed contacts which enable power to be supplied to the machine. When the guard door is opened the switch is positively actuated to open the normally closed contacts and thereby cut the power. However, many personnel override or bypass the safeguard provided by this switch, which is intended to protect them from injury, in order to gain easier access to the machine to avoid the inconvenience of having to wait for the machine to power down.

In a cam operated safety switch the rotary motion of a cam moves the switch between two operating conditions, a first position where the normally closed contacts of a solenoid are closed and power supplied, and a second wherein the normally closed contacts are open and the power is disabled. The movement of the cam is controlled by insertion of an actuator into and out of a housing of the cam, which actuator engages in and moves the cam to its first position. The cam is biased to its second position and removal of the actuator enables the cam to return to its second position. This has the disadvantage that it is relatively easy to remove the actuator and bypass the safety provided by the switch by insertion of a foreign object into the switch to permanently bias it towards its first position in which the power is supplied and thereby prevent it powering down the machine when its guard door is opened.

It is an object of the present invention to provide a safety switch which overcomes or alleviates the above described disadvantages. It is a further object to provide an anti-tamper safety switch system of the type operated by a cam mechanism.

In accordance with the present invention there is provided a safety switch system with guard locking comprising a cam mechanism, a cam operated solenoid switch, an actuator and a locking mechanism, wherein the cam mechanism comprises a rotary cam biased towards a datum position and a cam plunger biased onto the cam, and the switch comprises a solenoid plunger biased out of a housing of the switch towards the cam plunger and in which position the switch enables a power supply, whereby in the datum position of the cam the cam forces the cam plunger towards the solenoid plunger which in turn forces the solenoid plunger into the switch housing and in which position the switch is enabled to disable a power supply, and in order to move the switch to the condition which enables power the cam is provided with at least one engagement means to accept the actuator, insertion of the actuator is adapted to drive the rotation of the cam away from its datum position and to enable the cam plunger to engage in a detent in a profile on the cams surface thereby allowing movement of the biased cam plunger away from the solenoid plunger which in turn allows the solenoid plunger to be biased out of the housing, the engagement means and actuator are designed such that rotation of the cam away from its datum position means that the actuator cannot be withdrawn until the cam is moved back to its datum position, removal of the actuator enables movement of the cam back to its datum position and for power to be disabled, and wherein the locking mechanism has means to lock the actuator in the engagement means to prevent its removal when said power is supplied by the switch until certain operating conditions have been met, characterised in that the locking mechanism comprises a moveable safety arm which extends between the solenoid and cam plungers such that the cam plunger only acts on the solenoid plunger via the interposition of the moveable safety arm, the locking mechanism having means to lock movement of its arm when the cam plunger is in the detent to trap the cam plunger between the arm and the cam thus preventing its movement towards the solenoid plunger and thereby locking the rotation of the cam back to its datum position.

The locking arm may extend in a transverse plane to the plane of a longitudinal axis of the cam or solenoid plunger when it is locked.

The locking arm may be mounted for pivotal movement by the cam plunger towards the solenoid plunger.

The longitudinal axis of the cam and solenoid plungers may not lie in the same plane, and may be in parallel planes. This facilitates a pivoting movement of the arm towards the solenoid plunger.

The locking mechanism may comprise a sliding lock which is moveable into the path of movement of the arm to prevent it pivoting.

The locking mechanism may comprise a fixed running track for the sliding lock to enable it to move in and out of the path of the arm and stop means to fix the movement of the sliding lock to enable the locking, the stop means may comprise a fixed stop and a moveable stop which is provided on the solenoid plunger, the moveable stop of the solenoid plunger fixing the position of the sliding lock against the fixed stop when the solenoid plunger is biased out of the spring housing.

The solenoid plunger may have a profiled surface on its peripheral surface which protrudes from the switch housing, the sliding lock sits on this surface and is biased towards the solenoid plunger, the profiled surface of the solenoid plunger moves the sliding lock along its running track during movement of the solenoid plunger.

The profiled surface may comprise an annular shoulder with an inclined side surface, the sliding lock may have a complimentary profiled surface, wherein the top of the shoulder holds the sliding lock against the fixed stop when the solenoid plunger is biased out of the switch housing.

In a preferred embodiment the locking mechanism comprises two contact blocks which are operated independently by either the position of the solenoid plunger and the actuator, wherein each block has a number of normally closed and normally open contacts, and each contact block has a respective contact block plunger movement of which enables the opening and closing of the respective block contacts.

The safety arm may comprise an additional dependent arm which extends therefrom towards the contact block plunger of contact block A for actuation thereof, movement of the safety arm causes retraction and release of the contact block plunger into the contact block A by the dependent arm of the safety arm, block A providing an indication thereby of whether the actuator is inserted or not.

The locking means may also comprise an active plate operably connected to move with the solenoid plunger and to actuate the contact block plunger of contact block B, block B indicating thereby whether solenoid is energised or not and thereby indicate the lock status of the switch.

By way of example only a specific embodiment of the invention will now be described with reference to the accompanying drawings, in which: —

Figure 1:
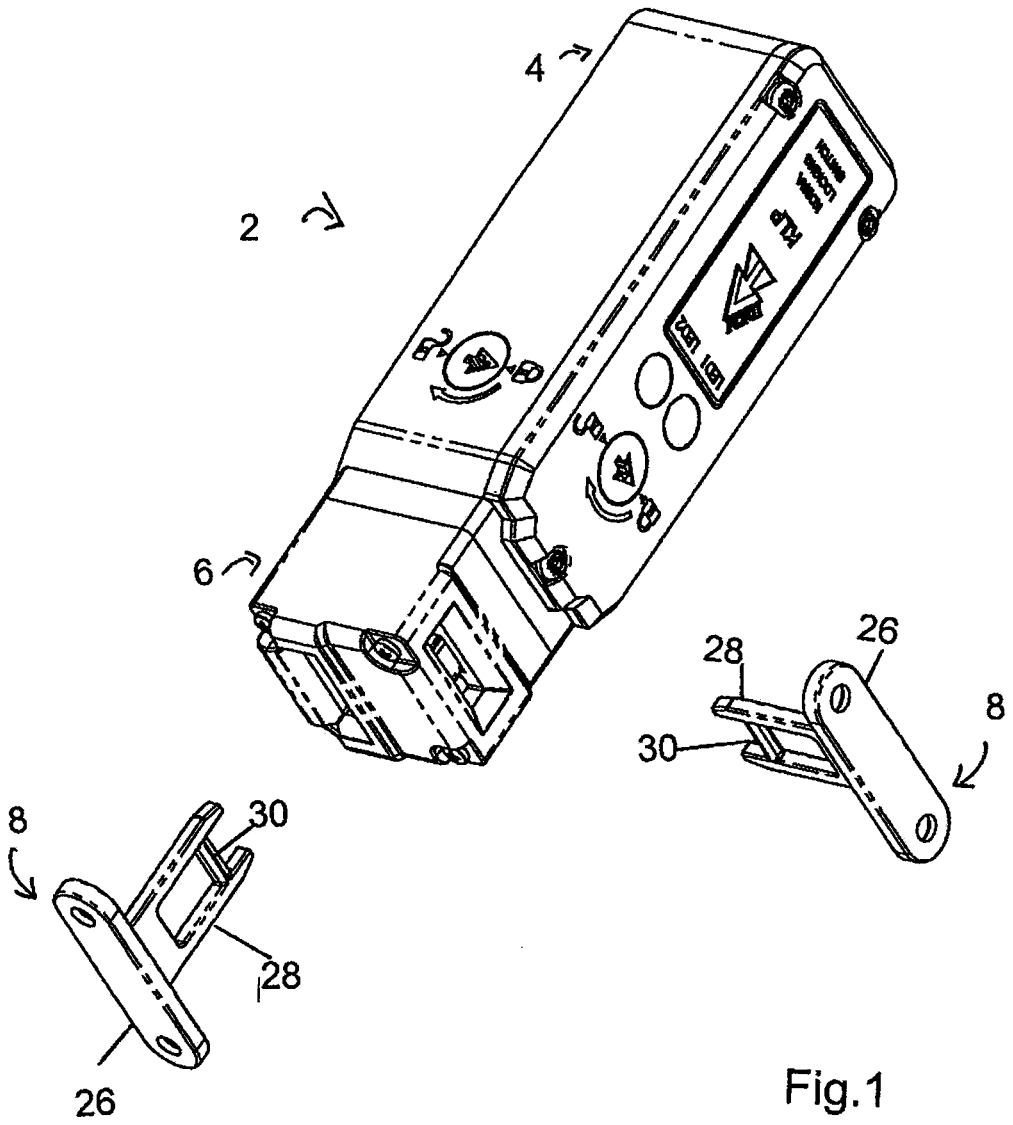
FIG. 1 is a perspective view of a switch with a cam system which operates the switch, the cam system being activated by an actuator.

The switch system 2, as best illustrated in FIG. 1, comprises a switch housing 4 and a cam mechanism 6 operabley connected thereto, which cam mechanism 6 is operated by insertion and removal of an actuator 8.

The switch 4 is of the positively operated type in which the switch must be positively operated by the cam mechanism 6 in order to cut power supplied to attendant equipment (not illustrated).

Figure 2:
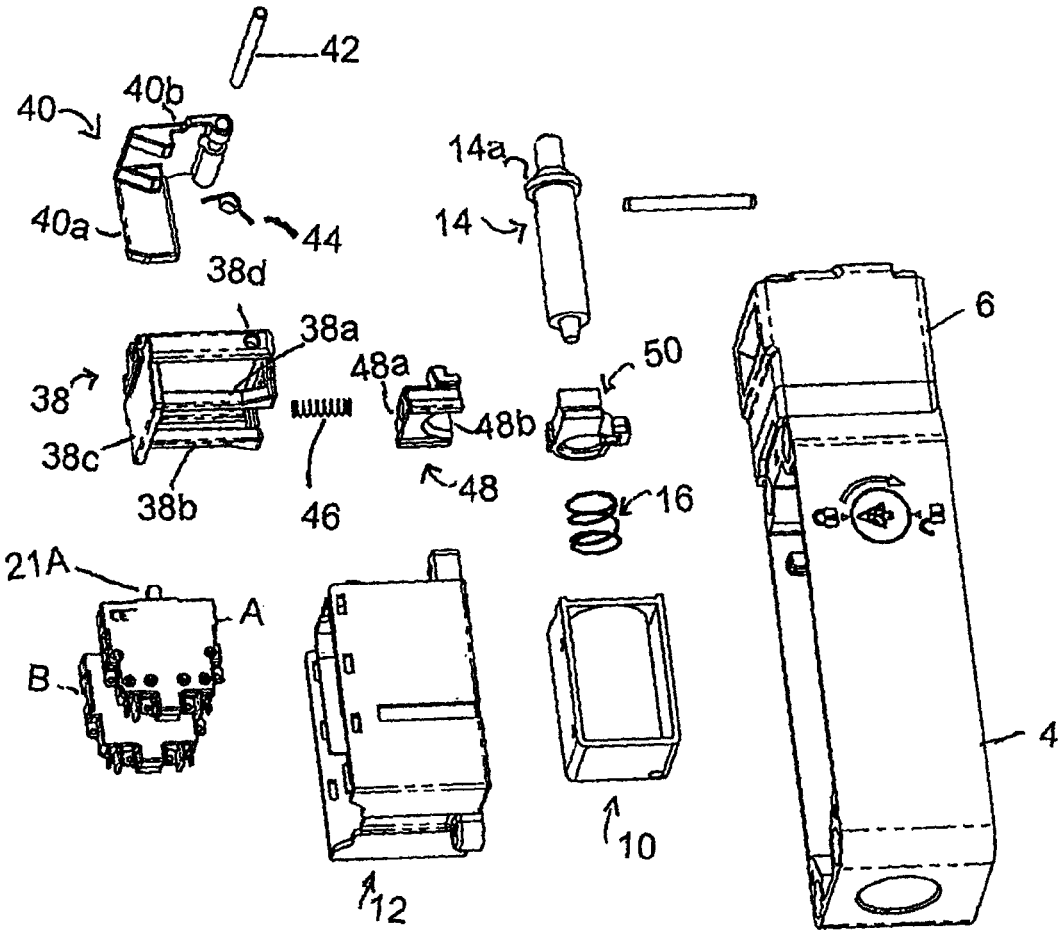
FIG. 2 is an exploded view of the components in the switch to show the locking mechanism constructed in accordance with the invention.
Figure 3:
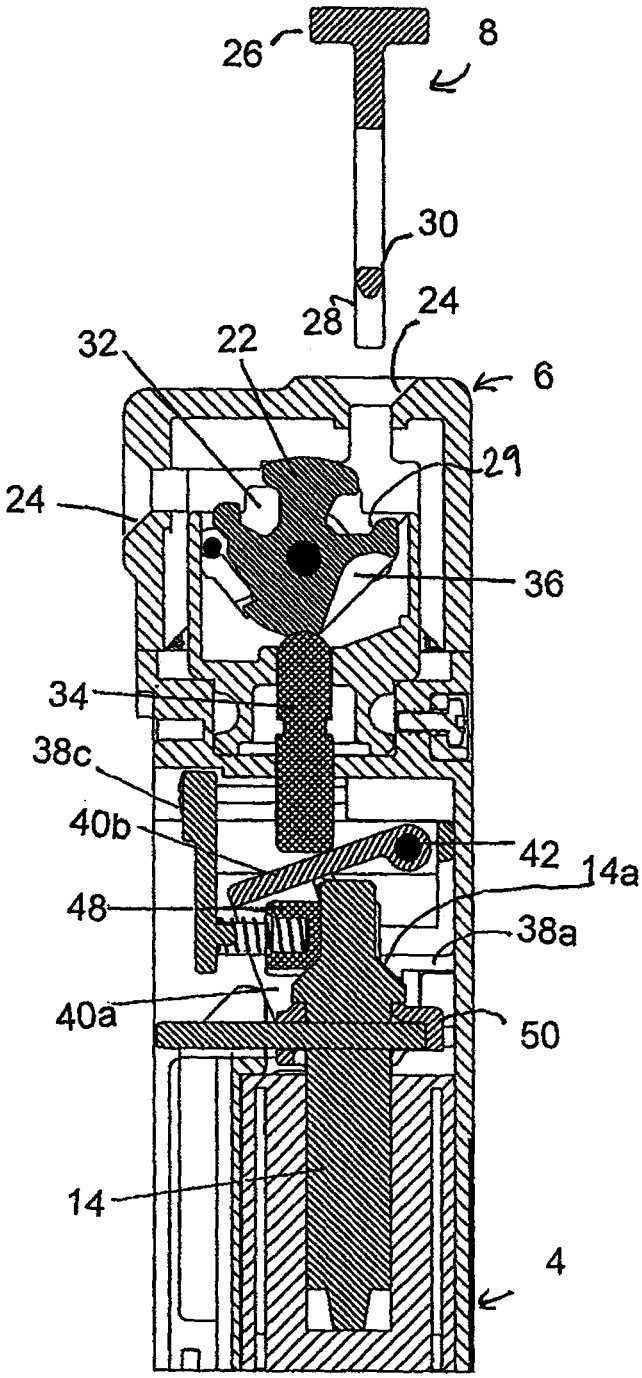
FIG. 3 is a sectional view of the switch and cam system in the condition when the actuator is not inserted and the normally closed contacts in the switch are open.
Figure 4:
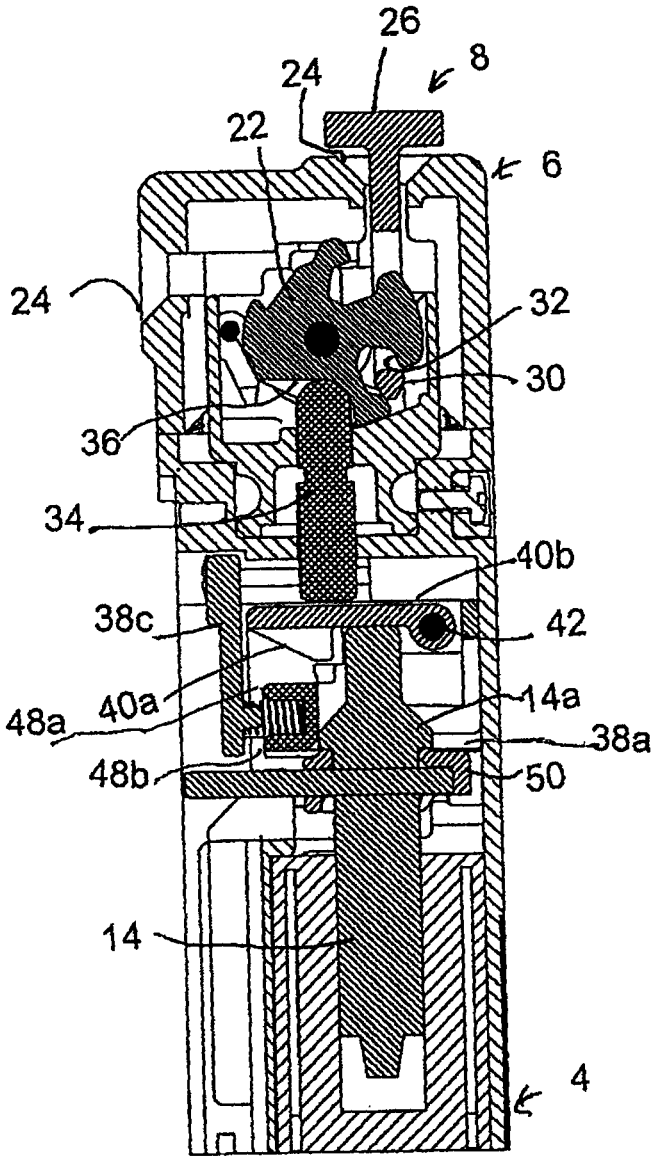
FIG. 4 is a view similar to that of FIG. 3 but with the actuator inserted and the normally closed contacts closed.
Figure 5:
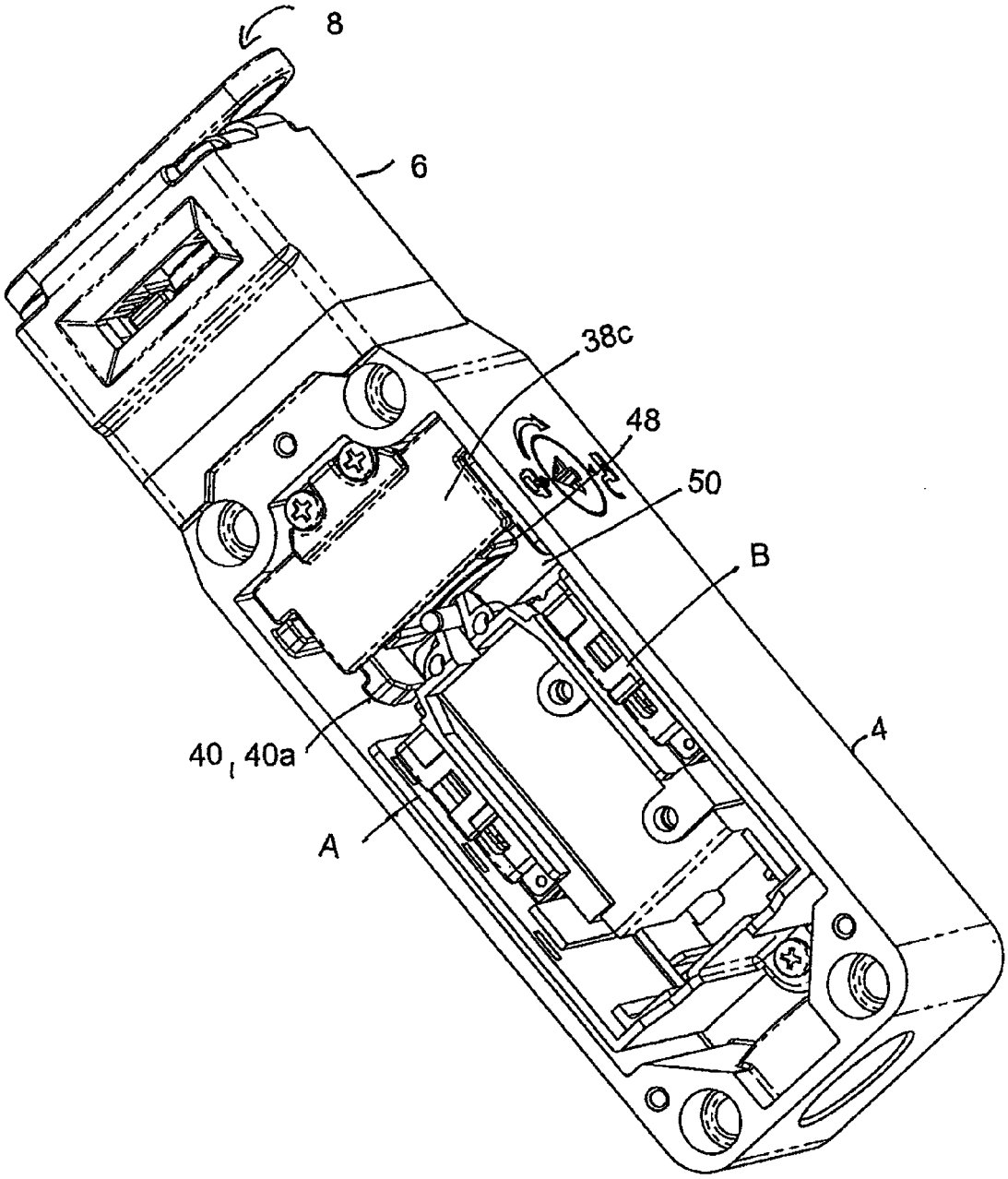
FIG. 5 is a detailed view of the contact blocks in the switch showing their relationship to the active plate and safety arm of the locking mechanism.

As best illustrated in FIGS. 2 to 4, the switch housing 4 contains a solenoid which comprises a solenoid body 10 housed in a solenoid cover 12. The solenoid body 10 in turn houses a spring loaded solenoid plunger 14 which is enabled for reciprocal movement between two positions along a predetermined axis, a first of which (show in FIG. 4) in which the switch is enabled to supply power and a second position (shown in FIG. 3) when the switch is positively actuated and the power to attendant machinery is disabled. The solenoid plunger 14 is moved between these two positions by the cam mechanism 6, described later further herein under.

The solenoid plunger 14 is biased by its spring 16 out of the solenoid body 10 to its first position. The protruding end of the solenoid plunger extends towards the cam mechanism 6.

Figure 7:
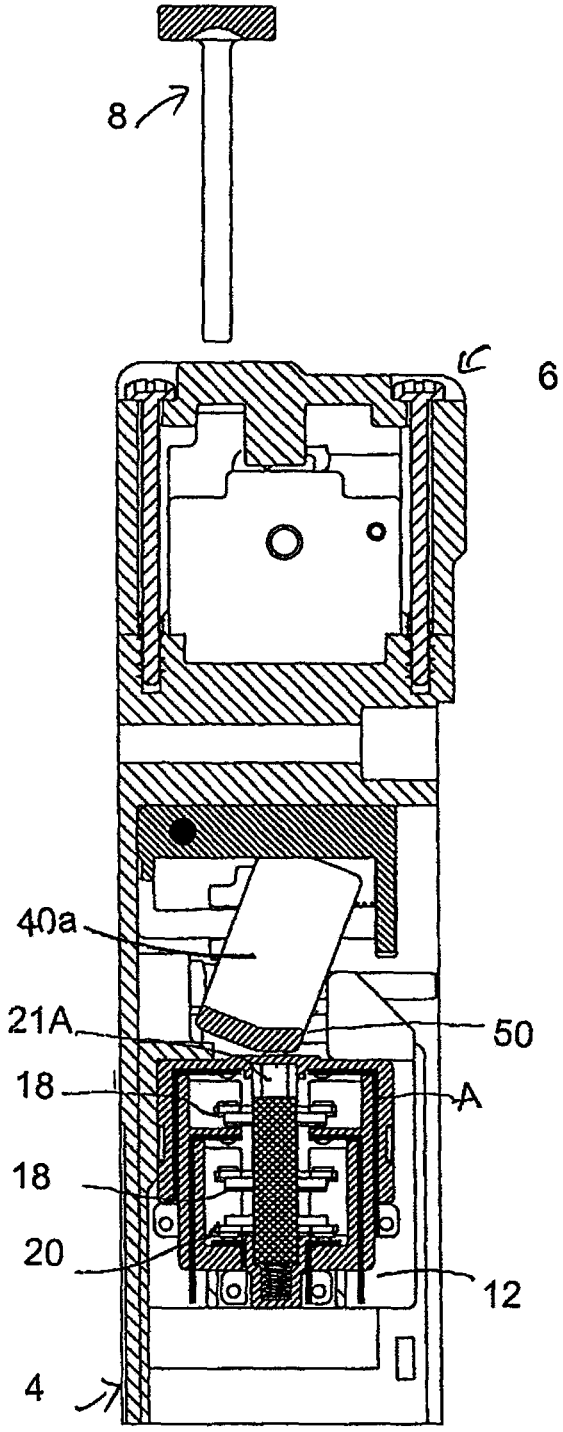
FIG. 7 is a view similar to that of FIG. 6 illustrating the relationship when the actuator is removed.
Figure 8:
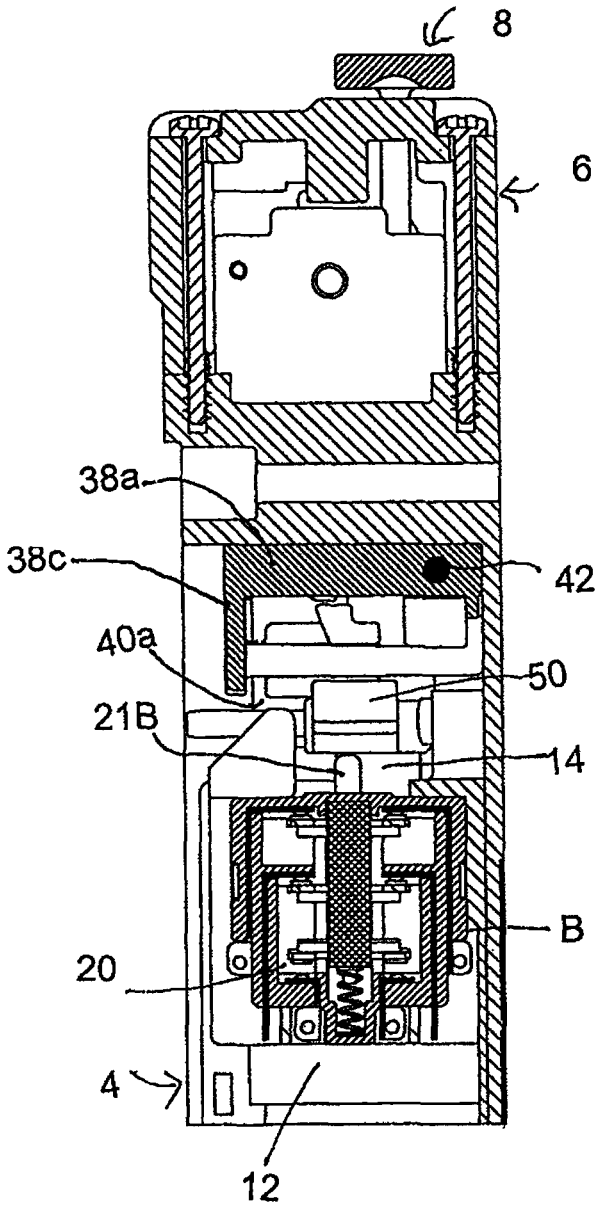
FIG. 8 is a sectional view of the switch showing contact block B and its relationship to the active plate when the actuator is inserted.
Figure 9:
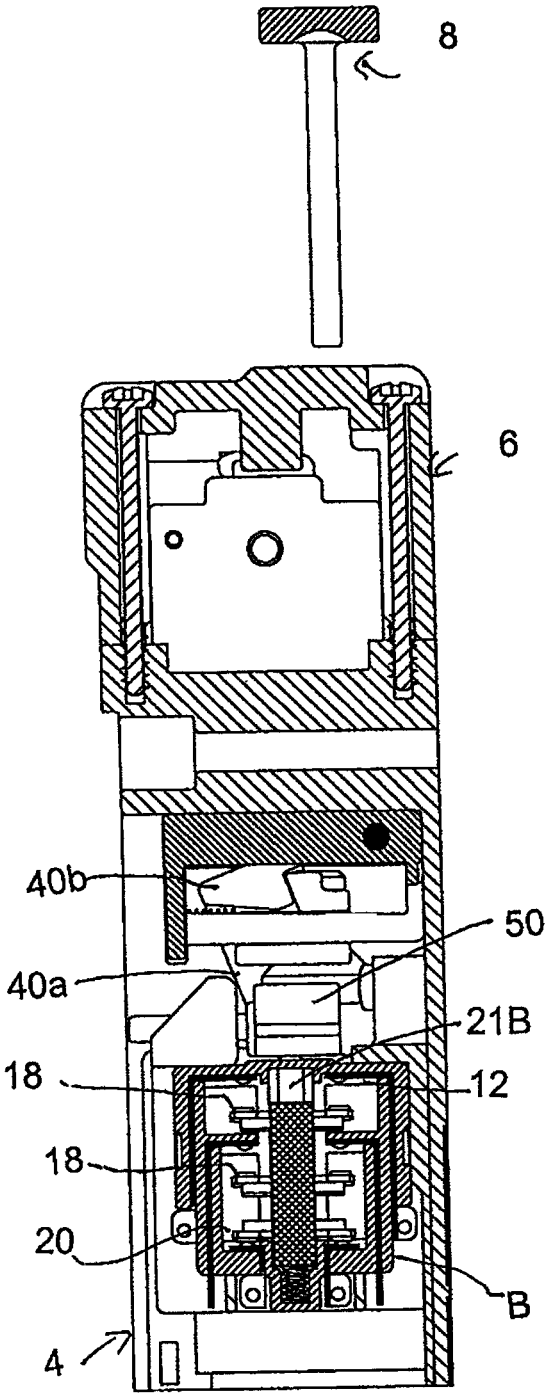
FIG. 9 is similar to that of FIG. 8 illustrating the relationship when the actuator is removed.

Two contact blocks A and B, best illustrated in FIG. 2 and FIGS. 5 to 9, are mounted in the solenoid cover 12 next to the solenoid body 10 as best illustrated in FIGS. 2 and 9. Each block A and B has a number of normally closed 18 and normally open 20 contacts as best illustrated in FIGS. 6 to 9. In the said first position of the solenoid plunger 14, see FIGS. 6 and 8, the normally closed or safety contacts 18 of contact block A (see FIG. 6) and of contact block B (see FIG. 8) are closed and power is supplied. In this position the normally open contacts 20 of the switch are open. In said second position of the solenoid plunger 10, the normally closed contacts 18 are opened and the normally open 20 contacts closed, see FIG. 7 for contact block A and FIG. 9 for contact block B and the power is cut to attend machinery. Each contact block A, B has a respective contact block plunger 21A, 21B movement of which enable the opening and closing of the contacts.

As mentioned above the solenoid plunger 10 is moved between its two positions by the action of the cam mechanism 6.

The cam mechanism 6 as best illustrated in FIGS. 3 and 4 houses a disc shaped cam 22 which is journaled therein for rotary movement between two positions, a first position shown in FIG. 4 to which it must be positively rotated and a second position show in FIG. 3. The cam 22 is spring loaded, not illustrated, and is biased thereby for movement to its second position. In the first position power is supplied by the switch, in its second position the power is cut. The cam 22 has a profiled surface about its circumference.

The cam mechanism 6 has two insertion openings 24 (FIGS. 1, 3 and 4) for selective insertion of the actuator 8. The plurality of insertion openings 24 enable the mounting of the combined switch and cam mechanism unit 2 at a variety of geometric locations.

The actuator 8 comprises a head 26 with a two pronged or bifurcated shaft 28. A cross-bar 30 interconnects the two prongs 28 of the shaft remotely from its ends, this provides a substantially H-shaped configuration to the shaft. The cross-bar 30 is adapted to engage in one of two engagement grooves 32 on the cam's 22 profiled surface when the actuator 8 is inserted into one of the openings 24. In the second position of the cam 22 a respective one of the engagement grooves 32 is aligned with a respective one of the openings 24. Upon insertion of the actuator 8 through one of the openings 24 its cross-bar 30 engages in a respective engagement groove 32 and further insertion rotates the cam 22 clockwise. The shape of the actuator 8 and its engagement within the cam 22 is designed to prevent easy removal of the actuator 8 when the cam 22 is in the first position. In this position the cam housing opening 24 is no longer in direct alignment with the respective actuator engagement groove 32 and the removal of the actuator 8 is blocked by the cam's body which has rotated across the opening. To prevent forced removal a locking mechanism is further provided which prevents forced removal of the actuator 8 until certain conditions are met. The locking mechanism will be described later herein under.

The rotation of the cam 22 moves a spring loaded cam plunger 34 mounted in the cam mechanism 6 between first and second positions. In the first position shown in FIG. 4 the power is supplied, in the second shown in FIG. 3 the power is cut. The first position of the cam plunger 34 is enabled when the actuator 8 is fully inserted in the cam mechanism 6, and the second when it is removed. As the cam 22 is rotated into its first position, a plunger detent 36 provided in the profiled surface of the cam comes into alignment with said contacting end of the plunger 34. The cam plunger 34 is biased towards the cam's 22 profiled surface and as the cam 22 rotates the contacting end of the cam plunger 34 is forced by its spring into the plunger detent 36. When the actuator 8 is removed the spring loaded cam 22 is rotated back to its second position and the plunger detent 36 moved away from the cam plunger 34, the profiled surface acting against the spring loading of the cam plunger 34 to return it to its second position.

The opposite, or non-cam contacting end of the cam plunger 34 acts to indirectly operate the solenoid plunger 14, described further hereinunder. As mentioned above the solenoid plunger 14 is biased for movement out of the solenoid 10, and towards the cam mechanism 6 into its first position. When the cam plunger 34 is in its first position by rotation of the cam 22 to its first position (when the actuator 8 is inserted) the cam plunger 34 moves away from the solenoid plunger 14 to enable it to be biased to its first position and power is then enabled. When the actuator 8 is removed and the cam 22 returns to its second position the cam plunger 34 is moved towards the solenoid plunger 14 and the solenoid plunger 14 is forced against its spring 16 into its second position and the power is cut.

The above mentioned locking mechanism is provided which prevents the normally closed contacts 18 being opened and the actuator 8 removed until predetermined conditions have been established and thereby prevents for example a guard door of a machine being opened before the machinery has come to a holt.

The locking mechanism comprises, as best illustrated in FIG. 2, a locking frame 38, a safety arm 40, a safety arm axle pin 42, a safety arm spring 44, a sliding lock spring 46, a sliding lock 48 and an active plate 50. The contact blocks A and B additionally form a part of the locking mechanism. The locking frame 38, as illustrated in FIGS. 3 to 9, is rigidly mounted in the switch housing 4 between the solenoid 10 and the cam mechanism 6. The locking frame 38 comprises two pairs of parallel, spaced apart rails 38*a*, 38*b* which provide a running track for the movement of the sliding lock 48 and which retains the sliding lock 48 for selective sliding movement up and down within the rails of the frame between two positions. The sliding lock spring 46 is provided between a top cover 38*c* of the locking frame 38 and the sliding lock 48. The top cover 38*c* interconnects the rail pairs 38*a*, 38*b*. The spring 46 biases the sliding lock 48 towards the base of the locking frame 38. The sliding lock 48 has a bore 48*a* in its top end opposite the top cover 38*c* of the locking frame 38 to retain the spring 46. The bottom end of the sliding lock 48 carries a detent 48*b* adapted to slidingly engage over the protruding end of the solenoid plunger 14.

The solenoid plunger 14, as best illustrated in FIG. 2, comprises an annular shoulder 14*a* which is concentric to the central longitudinal axis of the solenoid plunger 14 and adjacent to its protruding end. Movement of the solenoid plunger 14 between its first and second positions enables movements of the sliding lock 48 within the locking frame 38. As best illustrated in FIGS. 3 and 4, when the solenoid plunger 14 (FIG. 3) is in its second position and the safety contacts 18 are open and the power supplied to the equipment is cut, the sliding lock 48 is biased to sit in its second position which is towards the base of the frame 38 and in this position engages over said protruding end. As the solenoid plunger 14 (FIG. 4) moves to its first position, to enable the re-establishment of the power, the shoulder 14*a* on the solenoid plunger 14 forces the sliding lock 48 up the frame 38, against the force of its spring 46, towards its first position at the top 38*c* of the frame 38. To this end the shoulder 14*a* has an inclined or sloping surface, a complementary surface is provided on the mating surface 48*b* of the sliding lock 48 to provide a smooth transition during movement up and down.

The safety arm 40, as best illustrated in FIG. 2 comprises two plates 40*a*, 40*b* jointed at a right-angle to one another, the base of one plate 40*b* carries the safety arm axle pin 42 and the safety arm 40 is journaled by the pin 42 to the base 38*d* of the locking frame 38 and between the oppositely disposed rails 38*a*, 38*b* such that the other plate 40*a* of the safety arm is moveable between the rails 38*a*, 38*b* towards the solenoid contact block A.

Figure 6:
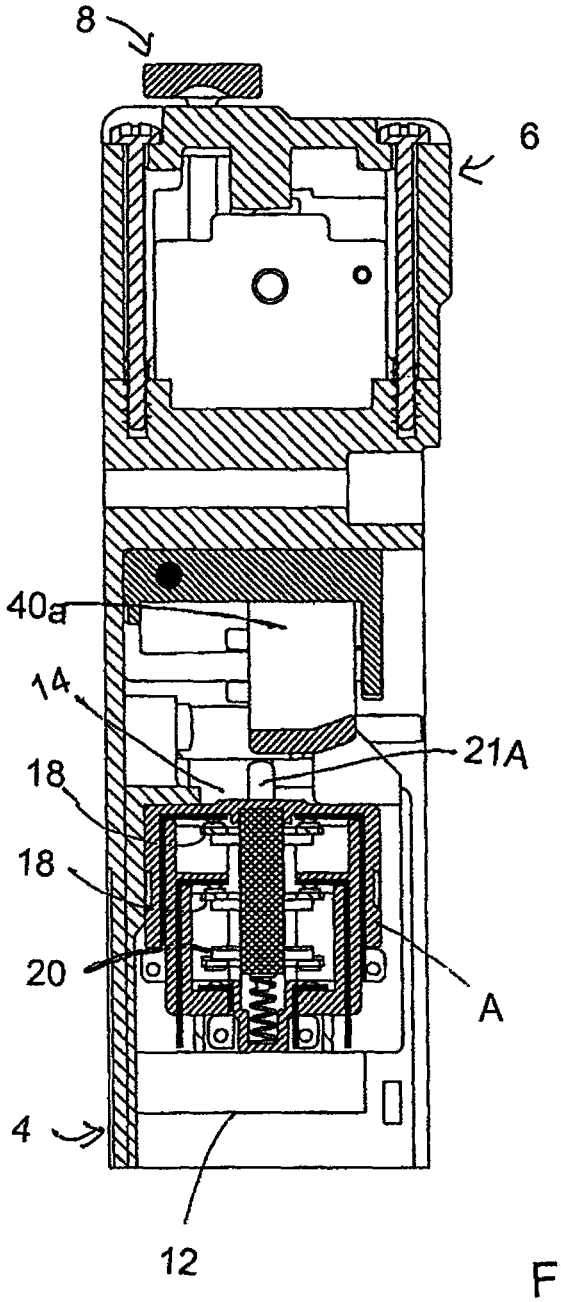
FIG. 6 is a sectional view of the switch showing contact block A and its relationship to the safety plate when the actuator is inserted in the cam.

As mentioned previously the cam plunger 34 does not act directly on the solenoid plunger 14 but via the safety arm 40, since the safety arm 40 is positioned between these two plungers 34, 14. The safety arm 40 is moveable between two positions a first of which is shown in FIGS. 4, 6 and 8 in which the actuator is inserted, power is enabled and the normally closed contacts are thereby closed, and a second position shown in FIGS. 3, 7 and 9 in which the actuator is removed, power is cut and thereby the normal (closed) contacts open. The safety arm 40 is rotated between those two positions by the position of the sliding lock 48.

In the first position of the safety arm 40 its plate 40*b* extends transversely to the longitudinal axis of plungers 14 and 34 with its plate 40*b* between the plungers 14 and 34, plate 40*a* is held at the top 38*c* of the locking frame by the sliding lock 48 (shown in FIG. 4). In this position the actuator 8 is locked in the cam mechanism and the cam plunger 34 is blocked by the plate 40*b* from movement towards the solenoid plunger 14. To this end the solenoid plunger 14 extends out the solenoid 10 to its first position in which its annular shoulder 14*a* holds the sliding lock 48 in its upper or first position. The actuator 8 is locked because it is not possible to rotate the cam 22 by removal of the actuator 8, this is because the movement of the cam plunger 34 out of the detent 36 in the cam 22 is blocked by the safety arm 40*b*, and this consequently prevents rotation of the cam. The bar 30 of the actuator 8 is held in opening 34, which is in a position rotated away from opening 24 and therefore cannot be removed. Therefore actuator 8 locking is achieved by preventing movement of the cam plunger arm 40 when the sliding lock 48 is in its upper or first position towards the top 38*c* of the locking frame 38. It is only possible to remove the actuator 8 by enabling movement of the cam plunger 14 to its second position, thereby enabling its movement out of the detent 36 on the cam profile to allow movement of the cam 22 back to its second position. Movement of the cam plunger 14 to its second position is enabled when the solenoid plunger 14 is retracted (energised), that is moved to its second position, enabling the sliding lock 48 to move to its second position towards the base of the locking frame 38. When the solenoid plunger 14 is in its retracted position power to the attendant machinery is cut. In this position the safety arm 40 is able to be moved by the cam plunger 34, since it is no longer blocked by its abutment with the sliding lock 48 as the cam plunger 14 is moved by rotation of the cam 22 during removal of the actuator 8.

The position of the sliding lock 48 is dependant on the solenoid plunger 14 position.

The two contact blocks A and B are operated independently by either the position of the solenoid plunger 14 (to indicate solenoid energised or not) and the actuator (to indicate inserted or removal).

As mentioned above when the solenoid plunger 14 is retracted to its second position (energised to enable unlocking) the spring loaded sliding lock 48 is allowed to drop into its lower position within the rails 38*a* and 38*b* of the locking frame 38 and move clear of its abutment with the safety arm 40. In this position contact block B will operate by abutment between its contact block plunger 21B and the active plate 50 which connects to the solenoid plunger 14 (see FIG. 9). The closed contacts 18 will open and the open contacts 20 will close and the switch will be unlocked and the machine will be stopped. This will allow the actuator 8 to be removed from the cam 22, which will now be able to rotate and push the cam plunger 14 enabling the now unlocked safety arm 40 to be moved by the cam plunger 14 and to rotate towards the solenoid 10. The safety arm plate 40*a* (as best illustrated in FIG. 7) then moves towards contact block plunger 21A causing it to retract into the contact block A to operate contact block A and open the normally closed contacts 18 of block A and close its normally open contacts 20.

Conversely insertion of the actuator 8 into the cam mechanism 6 enables the cam plunger 34 to move into the cam detent 36 as the cam 22 is rotated to bring the detent 36 in register with the cam plunger 34. This enables the spring loaded safety arm 40 to return to its first position. The spring loaded solenoid plunger 14 is then able to follow the cam plunger 34. The sliding lock 48 then moves back up the locking frame 38 to its first position, pushed by the annular shoulder 14*a* on the solenoid plunger 14. This causes the safety arm 40 to once again be locked in its first position, preventing it from being rotated back to its second position until the solenoid plunger 14 is retracted. Movement of the safety plate 40 back to its first position releases contact block plunger 21A to activate the switch enabling the normally closed contacts 18 to close and the normally open contacts 20 to open, enabling power to be supplied to the machinery. Movement of the solenoid plunger 14 out of the solenoid moves active plate 50 out of engagement with contact block plunger 21*b*, enabling its actuation and the normally closed contacts 18 to close, and the normally open contacts to open, enabling power to be supplied to the machinery.

The invention claimed is:

1. A safety switch system with guard locking comprising a cam mechanism, a cam operated solenoid switch, an actuator and a locking mechanism, wherein the cam mechanism comprises a rotary cam biased towards a datum position and a cam plunger biased onto the cam, and the switch comprises a solenoid plunger biased out of a housing of the switch towards the cam plunger and in which position the switch enables a power supply, whereby in the datum position of the cam the cam forces the cam plunger towards the solenoid plunger which in turn forces the solenoid plunger into the switch housing and in which position the switch is enabled to disable a power supply, and in order to move the switch to the condition which enables power the cam is provided with at least one engagement means to accept the actuator, insertion of the actuator is adapted to drive the rotation of the cam away from its datum position and to enable the cam plunger to engage in a detent in a profile on the cams surface thereby allowing movement of the biased cam plunger away from the solenoid plunger which in turn allows the solenoid plunger to be biased out of the housing, the engagement means and actuator are designed such that rotation of the cam away from its datum position means that the actuator cannot be withdrawn until the cam is moved back to its datum position, removal of the actuator enables movement of the cam back to its datum position and for power to be disabled, and wherein the locking mechanism has means to lock the actuator in the engagement means to prevent its removal when said power is supplied by the switch until certain operating conditions have been met, characterised in that the locking mechanism comprises a moveable safety arm which extends between the solenoid and cam plungers such that the cam plunger only acts on the solenoid plunger via the interposition of the moveable safety arm, the locking mechanism having means to lock movement of its arm when the cam plunger is in the detent to trap the cam plunger between the arm and the cam thus preventing its movement towards the solenoid plunger and thereby locking the rotation of the cam back to its datum position.

2. A system according to claim 1, wherein the locking arm extends in a transverse plane to the plane of a longitudinal axis of the cam or solenoid plunger when it is locked.

3. A system according to claim 1 or 2, wherein the locking arm is mounted for pivotal movement by the cam plunger towards the solenoid plunger and is biased for return movement towards the cam plunger.

4. A system according to claim 1, wherein the longitudinal axis of the cam and solenoid plungers do not lie in the same plane.

5. A system according to claim 4, wherein the axis lie in parallel planes.

6. A system according to claim 1, wherein the locking mechanism comprises a sliding lock which is moveable into the path of movement of the arm to prevent it pivoting.

7. A system according to claim 6, wherein the locking mechanism comprises a fixed running track for the sliding lock to enable it to move in and out of the path of the arm and stop means to fix the movement of the sliding lock to enable the locking.

8. A system according to claim 7, wherein the stop means comprises a fixed stop and a moveable stop which is provided on the solenoid plunger, the moveable stop of the solenoid plunger fixing the position of the sliding lock against the fixed stop when the solenoid plunger is biased out of the spring housing.

9. A system according to claim 6, 7 or 8, wherein the solenoid plunger has a profiled surface on its peripheral surface which protrudes from the switch housing, the sliding lock sits on this surface and is biased towards the solenoid plunger, the profiled surface of the solenoid plunger moves the sliding lock along its running track during movement of the solenoid plunger.

10. A system according to claim 9, wherein the profiled surface comprises an annular shoulder with an inclined side surface, the sliding lock has a complimentary profiled surface, wherein the top of the shoulder holds the sliding lock against the fixed stop when the solenoid plunger is biased out of the switch housing.

11. A system according to claim 1, wherein the locking mechanism comprises two contact blocks which are operated independently by either the position of the solenoid plunger and the actuator, wherein each block has a number of normally closed and normally open contacts, and each contact block has a respective contact block plunger movement of which enables the opening and closing of the respective block contacts.

12. A system according to claim 11, wherein the safety arm comprises an additional dependent arm which extends therefrom towards the contact block plunger of contact block A for actuation thereof, movement of the safety arm causes retraction and release of the contact block plunger into the contact block A by the dependent arm of the safety arm, block A providing an indication thereby of whether the actuator is inserted or not.

13. A system according to claim 11 or 12, wherein the locking means comprises an active plate operably connected to move with the solenoid plunger and to actuate the contact block plunger of contact block B, block B indicating thereby whether solenoid is energised or not and thereby indicate the lock status of the switch.

* * * * *